US005518409A

United States Patent [19]

White

[11] Patent Number: 5,518,409

[45] Date of Patent: May 21, 1996

[54] SLIDING DIGITAL BOOKMARKER

[76] Inventor: Willard H. White, 1154 E. 27th South #119, Salt Lake City, Utah 84106

[21] Appl. No.: 334,924

[22] Filed: Nov. 7, 1994

[51] Int. Cl.[6] ..... B42D 9/00

[52] U.S. Cl. ..... 434/405; 116/234; 281/42; 434/199

[58] Field of Search ..... 434/199, 405; 116/234–239, 222, 225, 315, 321–324; 281/42; 283/41; 235/78 R, 78 G, 83, 88 R, 88 G

[56] References Cited

U.S. PATENT DOCUMENTS

| | | | |
|---|---|---|---|
| 1,289,743 | 12/1918 | Hammond | 434/199 |
| 4,189,143 | 2/1980 | Van Auken et al. | 273/73 R |
| 4,241,522 | 12/1980 | Jablonski | 434/199 |
| 4,928,621 | 5/1990 | Capamaggio | 116/234 |
| 5,305,706 | 4/1994 | Arjomand | 116/234 |
| 5,377,612 | 1/1995 | Catalano et al. | 116/234 |

*Primary Examiner*—Richard J. Apley
*Assistant Examiner*—Glenn E. Richman
*Attorney, Agent, or Firm*—Terry M. Crellin

[57] ABSTRACT

A bookmarker comprises a thin, planar base member. A thin, planar upper member has the shape of the base member with the perimeter edges of the upper member being permanently adhered to corresponding perimeter edges of the base member. At least two elongate linear slots are formed in the upper member. The slots are parallel with each other and spaced apart. A window opening is provided for each slot. Each window opening is located closely adjacent to a respective slot and between opposite ends of such slot. An elongate, thin slide member is provided for each slot. Each slide member is positioned between the base member and the upper member for sliding motion back and forth along a respective slot. The slide member has a width that spans the respective slot and the respective window opening for that slot. An elongate, raised rib projects from a surface of each slide member so that the rib is received in a respective slot for longitudinal sliding motion back and forth along such slot. The slot forms a guideway for the sliding motion of the rib and slide member. Numerical indicia comprising the numerals 0 through 9 are provided on each slide member such that the numerals can be viewed successively in the respective window opening as the slide member slides back and forth along a respective slot.

4 Claims, 1 Drawing Sheet

SLIDING DIGITAL BOOKMARKER

BACKGROUND OF THE INVENTION

1. Field of the Invention

The present invention relates broadly to bookmarkers and more particularly to a bookmarker in which the number of the reading page of a book can be registered and displayed. More particularly, the invention provides a bookmarker which has parallel aligned slide members that will register selected numerals from 0 through 9 in window viewing areas that are provided in the device.

2. State of the Art

Bookmarkers are well known and commonly used by a reader of a book to indicate the reading page of a book, i.e., the page on which the reader was reading or beginning to read when reader put the book down to do something else. Bookmarkers commonly take the shape of a flat piece of paper or the like as well as a ribbon of cloth that is positioned between the page of the book and on adjacent page.

In U.S. Pat. No. 3,918,390 a bookmarker is disclosed having a circular rotatable dial mounted on a stationary plate. The perimeter of the rotatable dial is divided into 100 equal sectors, and the sectors are numbered 0 through 99 in sequence. The stationary plate has ten marks spaced around the perimeter of the rotatable dial. The ten marks in the stationary plate comprise the numerals 0 through 9. Thus, one can rotate the dial to align the mark 1 on the stationary plate with the number 21 on the rotating dial. This would indicate that the reading page was 121. However, one must remember that the proper mark is the 1 on the stationary plate. If the reader forgets whether the reading page is in the one hundreds, two hundreds or up to the nine hundreds, there are nine possible pages that could be the reading page, and the reader must somehow determine which of the nine possibilities is the true reading page. In the example just given, i.e., the true reading page being 121, the device of U.S. Pat. No. 3,918,390 would also show that the reading page could be any of the pages 15, 227, 334, 440, 546, 652, 758, 864 and 970. This is confusing, and it could be hard for the reader if the last page read was 227, 121 or 334, especially if the elapse between the time when the read quit reading and restarted reading is several days.

In U.S. Pat. No. 4,241,522 there is shown a teaching aid comprising four elongate slide members that are housed in a frame. The frame has four elongate open spaces into which the respective slide members can be positioned. When the slide members are moved into the open spaces, the entire face of each slide member and the indicia placed on that face is visible. The slide members can be moved downwardly from the open spaces so as to cover portions of or all of the indicia on the slide member.

The frame of the device of U.S. Pat. No. 4,241,522 requires four separate and distinct track and rail means for receiving the slide members and for allowing the slide members to move downwardly into the frame from the open spaces so as to cover at least portions of the slide members. A window is positioned beneath each open space in the frame so that any selected single indicia on the respective slide member can be displayed in its corresponding window. The purpose of the teaching aid of U.S. Pat. No. 4,241,522 is to aid in teaching mathematical concepts such as addition, subtraction, multiplication and division.

OBJECTIVES AND BRIEF DESCRIPTION OF THE INVENTION

A principal objective of the present invention is to provide an inexpensive, easy-to-use, bookmarker in which elongate slide members having numerical indicia thereon are provided, with the indicia on the slide members being visible one numeral at a time as that numeral registers with a window in the upwardly facing member of the bookmarker, whereby the reading page of a book can be set in the windows of the bookmarker, with the number that is set being the only number showing on the bookmarker.

A particular objective of the present invention is to provide such a bookmarker wherein the bookmarker is made of inexpensive members that can be stamped out of paper and/or plastic sheets.

Another objective of the present invention is to provide such a bookmarker which has a plurality of strips of pressure sensitive adhesive material that can be used to adhere the bookmarker to the inside cover or a page of a book.

The above objectives are achieved in accordance with the present invention by providing a bookmarker that comprises a relatively thin, planar base member having solid, contiguous upper and lower surfaces. A relatively thin, planar upper member is positioned over the base member. The upper member has a shape that is the same as the base member, and the dimensions of the upper member is essentially the same as the dimensions of the base member. The perimeter edges of the upper member is permanently adhered to corresponding perimeter edges of the base member so as to form an enclosed pocket between the upper member and the base member.

At least two elongate, linear slots (preferably three) are provided in the upper member. The slots form elongate, narrow openings into the closed pocket formed between the base member and the upper member. The slots are substantially parallel with each other and spaced apart such that a linear axis of any slot is at least about one-half inch from a linear axis of any adjacent slot. A window opening is provided for each slot. Each window opening is located between opposite ends of its respective slot and spaced closely adjacent to that respective slot. Preferably, the opening is located intermediate the opposite ends of the respective slot.

A relatively thin, elongate slide member is provided for each slot. Each slide member is positioned in the closed pocket between the base member and the upper member. The slide member slides longitudinally back and forth along a respective slot. Each slide member has a width that spans the respective slot and the respective window for that slot. The slide member is guided in its longitudinal sliding movement along its respective slot in the upper member of the bookmarker device by an elongate, substantially linear, raised rib that projects from an upper surface of the slide member. The raised rib is positioned near one of the side edges of the slide member, and the raised rib is received in a respective slot for longitudinal sliding motion back and forth along such slot. The slot forms a guideway for the sliding motion of the rib and associated slide member. In addition to interacting with the slot to guide the slide member, the rib acts as a means for imparting movement to the slide member. The rib can be engaged by one's finger to move the rib back and forth in the slot.

Numerical indicia are provided on each slide member. The indicia comprises the numerals 0 through 9 aligned along the longitudinal length of the slide and near the elongate rib. The indicia registers with the respective window in the upper member of the bookmark device, and the numerals can be viewed successively (one at a time) in the respective window as the slide member is moved back and forth along its respective slot. The bookmarker is thus easily and quickly set to a specific number corresponding to the desired page of a book by simply sliding the slide members until the selected number is displayed in the windows of the bookmarker. The selected number remains displayed, and is the only number displayed, until the reader takes the book up to continue reading in the book. The number is immediately available to the reader to indicate what page of the book the read is to continue reading. Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 1:
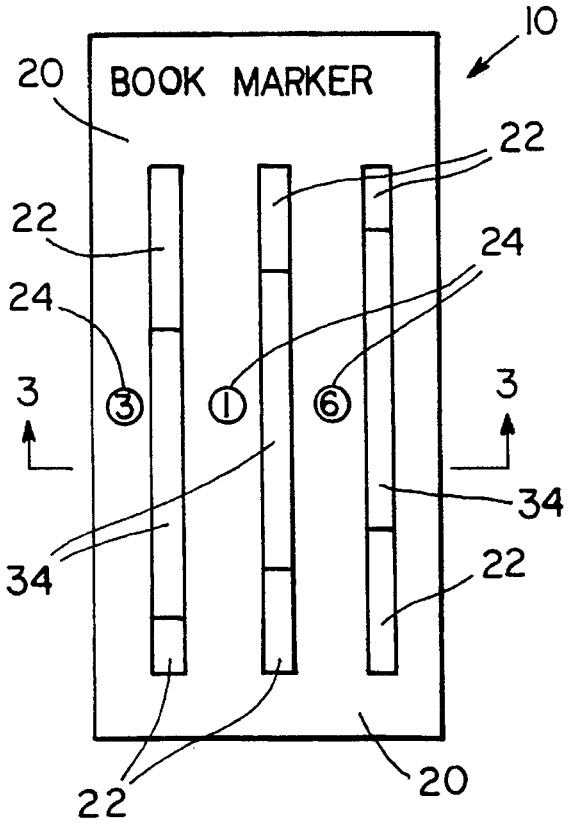
FIG. 1 is a front view of a sliding digital bookmark in accordance with the present invention.

Referring now to the drawings, a bookmarker 10 in accordance with the present invention comprises a relatively thin, planar base member 12. The planar base member 12 is essentially flat and preferably rectangular in shape. It has solid, contiguous upper and lower surfaces. The base member 12 is preferably made of paper, but could also be made from a plastic sheet or a thin metal sheet.

Figure 2:
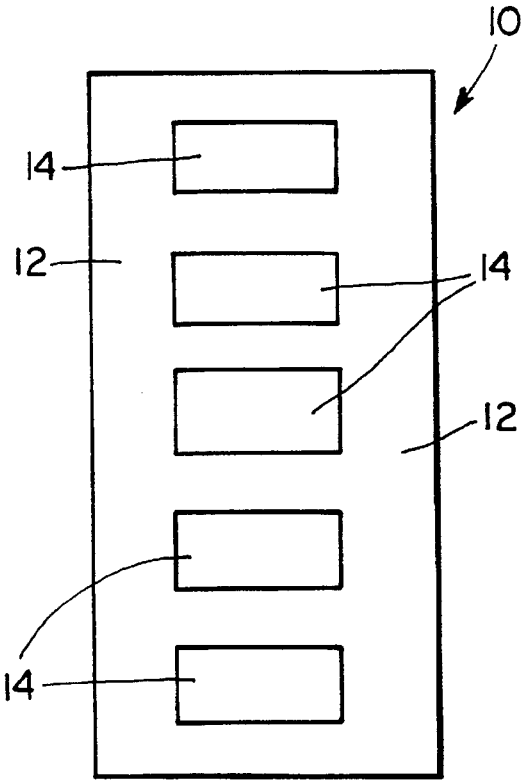
FIG. 2 is a back view of the bookmarker of FIG. 1.
Figure 3:
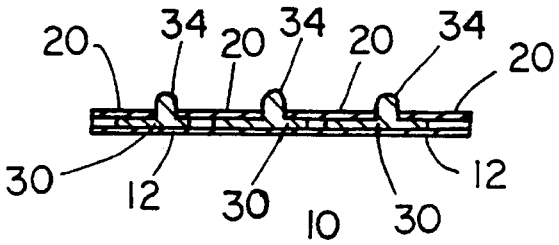
FIG. 3 is a cross section taken along line 3—3 of FIG. 1.
Figure 4:
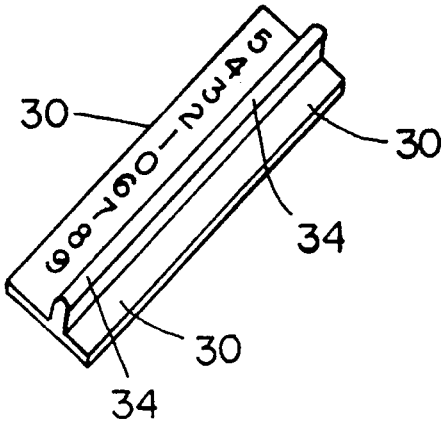
FIG. 4 is a pictorial view of one of the slide members of the bookmarker of FIG. 1.

A pressure sensitive adhesive is provided on the lower surface of the base member 12. As shown in FIG. 2, the pressure sensitive adhesive is preferably one or more strips 14 of pressure sensitive tape affixed to the lower or back surface of the planar base member 12. The strip 14 of tape can have a release paper on its exposed lower surface, and when the bookmarker is to be used, the release paper is removed exposing the pressure sensitive surface of the strip 14. The bookmarker can then be temporarily adhered to the inside of a book cover or to one of the initial few pages of the book. Advantageously, a plurality, i.e., three or more strips 14 can be placed on the lower surface of the planar base member 12 so that the bookmarker 10 an be used and reused on a plurality of books by uncovering a new strip 14 when a previously uncovered strip 14 is no longer adequately adhering to the book cover or page.

A relatively thin, planar upper member 20 has a shape that is substantially the same as the shape of the base member 12. The upper member is preferably made of paper, but could also be made from a sheet of plastic or a thin sheet of metal. The upper member 20 has essentially the same dimensions as the dimensions of the base member 12, and the perimeter edges of the upper member 20 are permanently adhered to corresponding perimeter edges of the base member 12.

At least two elongate linear slots 22 are provided in the upper member 20. The slots 22 are substantially parallel with each other and spaced apart such that a linear axis of any slot 22 is at least about one-half inch from a linear axis of any adjacent slot 22. A window opening 24 is provided for each slot 22. Each window opening 24 is located closely adjacent to a respective slot 22 and between opposite ends of such respective slot 22. Preferably, each slot 22 is positioned mid-way between opposite ends of a respective slot 22.

An elongate, relatively thin slide member 30 is provided for each slot 22. The slide member 30 is preferably made of paper, but can be made from a sheet of plastic or a thin sheet of metal. Each slide member 30 is positioned between the base member 12 and the upper member 20 for longitudinal sliding motion back and forth along a respective slot 22. Each slide member 30 has a width that spans its respective slot 22 and the respective window opening 24 for that slot 22.

An elongate, substantially linear, raised rib 34 projects from a surface of each slide member 30 so that the rib 34 is received in a respective slot 22 for longitudinal sliding motion back and forth along such slot 22. Each slot 22 in effect forms a guideway for the sliding motion of a respective rib 34 and slide member 30.

Numerical indicia comprising the numerals 0 through 9 are applied on each slide member 30 such that the numerals can be viewed successively in the respective window opening 24 associated with each slide member 30 as the slide member 30 slides back and forth along a respective slot 22. The bookmarker 10 can be set to a specific number corresponding to a desired page of a book by sliding the slide members 30 until the selected number is displayed in the window openings 24.

As illustrated, the bookmarker 10 has three elongate, linear slots 22, three window openings 24 and three slide members 30 such that the bookmarker 10 can be set at any desired page between 0 and 999. By providing one more each of the slots 22, window openings 24 and slide members 30, so that there would be four of each, the bookmarker 10 could be set at any desired page between 0 and 9999. It has been found advantageous to arrange the numerals on each slide member 30 in a lineal alignment in the order 5, 4, 3, 2, 1, 0, 6, 7, 8, 9 along the slide member 30.

Although a preferred embodiment of the bookmarker of the present invention has been illustrated and described, it is to be understood that the present disclosure is made by way of example and that various other embodiments are possible without departing from the subject matter coming within the scope of the following claims, which subject matter is regarded as the invention.

I claim:

1. A bookmarker that can be removably adhered to the inside of a book cover or one of the initial few pages of a book, said device comprising a relatively thin, planar base member having solid, contiguous upper and lower surfaces;

a pressure sensitive adhesive on the lower surface of said base member;

a relatively thin, planar upper member having a shape that is substantially the same as the shape of said base member with the upper member further having dimensions that are substantially the same as the dimensions of said base member, said upper member further having its perimeter edges permanently adhered to corresponding perimeter edges of said base member;

at least two elongate linear slots in said upper member, said slots being substantially parallel with each other and spaced apart such that a linear axis of any slot is at least about one-half inch from a linear axis of any adjacent slot;

a window opening for each slot, each window opening being located closely adjacent to and along a side of a respective slot and between opposite ends of such respective slot;

an elongate, relatively thin slide member for each slot, with each slide member being positioned between said base member and said upper member for longitudinal sliding motion back and forth along a respective slot, said slide member having a width that spans the respective slot and the respective window opening for that slot;

an elongate, substantially linear, raised rib projecting from a surface of each slide member so that said rib is received in a respective slot for longitudinal sliding motion back and forth along such slot, whereby the slot forms a guideway for the sliding motion of said rib and slide member; and numerical indicia comprising the numerals 0 through 9 on each slide member such that the numerals can be viewed successively in the respective window opening associated with each slide member as the slide member slides back and forth along a respective slot, whereby the bookmarker can be set to a specific number corresponding to a desired page of a book by sliding the slide members until the selected number is displayed in the window openings of the bookmarker.

2. A bookmarker in accordance with claim 1 wherein there are three elongate, linear slots, three window openings and three slide members such that the bookmarker can be set at any desired page between 0 and 999.

3. A bookmarker in accordance with claim 1 in which the numerals on each slide member are arranged in a lineal alignment in the order 5,4,3,2,1,0,6,7,8,9 along said slide member.

4. A bookmarker in accordance with claim 1 wherein the pressure sensitive adhesive comprise a plurality of strips of the pressure sensitive adhesive with a separate release covering on each strip, whereby a first release covering is removed to adhere the bookmarker to the inside cover or page of a book and a subsequent release covering is removed as needed when the bookmark is adhered to the inside cover or page of a subsequent book.

* * * * *